US006142122A

United States Patent [19]

Hoppenstedt

[11] Patent Number: 6,142,122

[45] Date of Patent: Nov. 7, 2000

[54] FUEL INJECTION VALVE FOR INTERNAL COMBUSTION ENGINES

[75] Inventor: Martin Hoppenstedt, Stuttgart, Germany

[73] Assignee: DaimlerChrysler AG, Stuttgart, Germany

[21] Appl. No.: 09/336,719

[22] Filed: Jun. 21, 1999

[30] Foreign Application Priority Data

Jun. 20, 1998 [DE] Germany ..... 198 27 628

[51] Int. Cl.[7] ..... F02M 37/04

[52] U.S. Cl. ..... 123/469; 123/470

[58] Field of Search ..... 123/468, 469, 123/470

[56] References Cited

U.S. PATENT DOCUMENTS 6,019,088 2/2000 Stevens ..... 123/470
6,050,614 4/2000 Kirkpatrick ..... 123/469

FOREIGN PATENT DOCUMENTS 196 08 575 A1 9/1997 Germany .
8-270530 10/1996 Japan .
2310890 9/1997 United Kingdom .

*Primary Examiner*—Thomas N. Moulis
*Attorney, Agent, or Firm*—Evenson, McKeown, Edwards & Lenahan, P.L.L.C.

[57] ABSTRACT

A fuel injection valve for internal combustion engines. The valve includes a nozzle needle longitudinally displaceably guided in a nozzle body and having a tensioning nut which axially braces the nozzle body with a nozzle holder, optionally, by way of a transition piece whose respective faces rest on an adjacent face. The valve also includes at least one feed pipe extending in the nozzle holder and the nozzle body, and fuel-carrying transfer points between the nozzle holder and the nozzle body. A portion of at least one of interacting faces (3*a;* 4*a*) being constructed as a raised contact surface (11) with surface elements surrounding the fuel-carrying transfer points.

21 Claims, 3 Drawing Sheets

FUEL INJECTION VALVE FOR INTERNAL COMBUSTION ENGINES

BACKGROUND AND SUMMARY OF THE INVENTION

This application claims the priority of 198 27 628.1, filed Jun. 20, 1998, the disclosures of which is expressly incorporated by reference herein.

The invention relates to a fuel injection valve for internal combustion engines, and more particularly, a fuel injection valve having a nozzle needle longitudinally and displaceably guided in a nozzle body. A tensioning nut axially braces the nozzle body with a nozzle holder. optionally, by way of a transition piece whose respective faces rest on an adjacent face, the fuel injection valve may also have at least one feed pipe extending in the nozzle body and the nozzle holder, having fuel-carrying transfer points between the nozzle holder and the nozzle body.

It is known that fuel injection valves used in high-pressure injection systems suffer from leakages at the interface between the nozzle body and the nozzle holder. This is because, depending on the injection system, fuel is intermittently or continuously subjected to high pressure in this area.

To avoid leakage risks, a fuel injection valve is known from German Patent Document DE 196 08 575 A1, in which an intermediate disk is clamped in between the nozzle body and the nozzle holder. The intermediate disk sealingly rests in a special manner by means of faces on the axial faces of the nozzle body and the nozzle holder. For increasing the sealing effect of the intermediate disk, which is required particularly in the case of injection valves with very high injection pressures, one of the interacting faces on the nozzle body and on the intermediate disk is constructed to be arched toward the outside in a crowned manner. This construction provides a uniform distribution of force at the sealing cross-section on the intermediate disk and on the nozzle body.

In high-pressure injection systems, particularly common rail systems, prestressing force is increased for ensuring tightness. However, this prestressing force may result in a deformation of the nozzle body, whereby the close play between the nozzle needle and the nozzle body is no longer ensured. This would result in friction and wear.

It is an object of the present invention to reliably seal off by special measures at the fuel injection valve, the connection between the nozzle body and the nozzle holder, without increasing prestressing forces. The measures taken should also be suitable for systems which are subjected to particularly high pressures, for example, common rail injection systems.

As the result of the measures according to the invention, by means of a raised contact surface having surface parts, a targeted relief of all surfaces on one of the interacting faces is achieved which are not absolutely necessary for the sealing. Thus the surfaces are at least reduced to the endangered fuel transfer points.

The raised contact surface may be provided with another surface part which, as an additional support point, offers a secure hold of the mutually braced housing parts of the fuel injection valve.

In this case, it is particularly advantageous for a surface part to extend on the outside diameter of the face, which results in an optimal supporting and sealing function which is preferably suitable for injection systems which are operated with high fuel pressures.

BRIEF DESCRIPTION OF THE DRAWINGS

These and other objects of the invention are illustrated in the drawing and will be explained in detail in the following by means of embodiments.

DETAILED DESCRIPTION OF THE DRAWINGS

Figure 1:
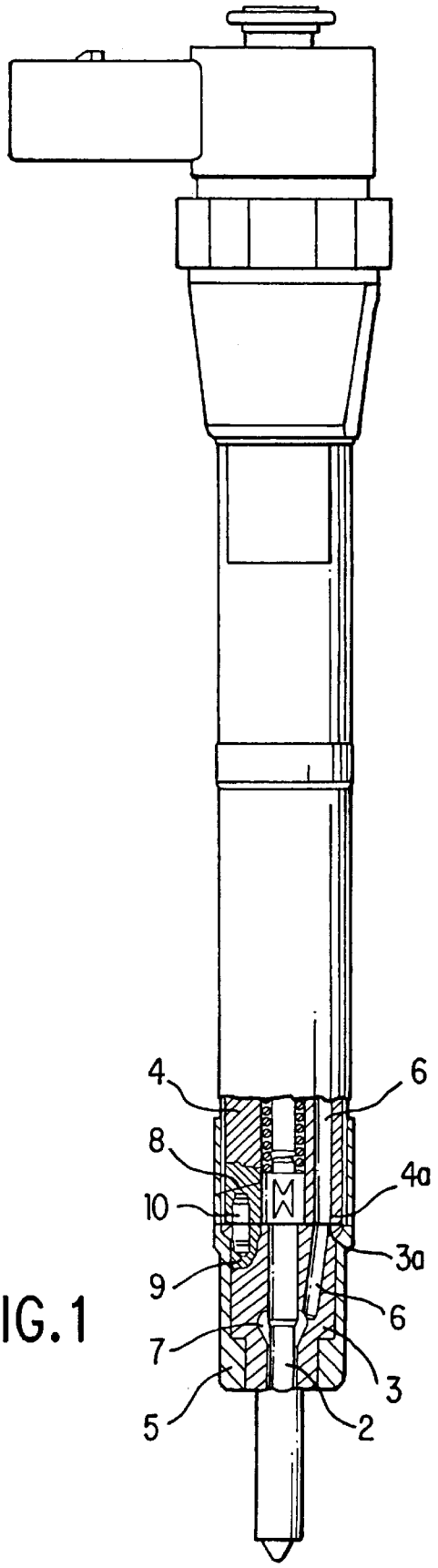
FIG. 1 is a partially sectional view of a fuel injection valve having an interface between the nozzle holder and the nozzle body.

As illustrated in FIG. 1, an injection valve 1, which is preferably used in a common rail system, has a solenoid valve control in the lower area thereof. The valve 1 is composed of a nozzle body 3, which contains a nozzle needle 2, and a nozzle holder 4. Nozzle body 3 and nozzle body 4 being axially braced by means of a tensioning nut 5. A feed pipe 6, which extends eccentrically in the nozzle holder 4 and the nozzle body 3, leads into a pressure chamber 7 surrounding the nozzle needle 2. Opposite the feed pipe 6, blind holes 8, 9 are situated in the nozzle body 3 and the nozzle holder 4, for receiving a pin 10 which secures the nozzle body 3 with respect to the nozzle holder 4 against torsion.

Figure 3:
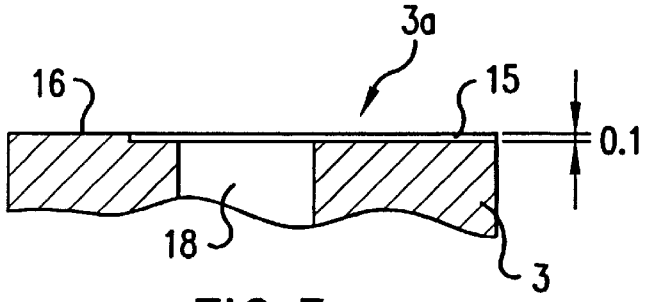
FIG. 3 is a view of the nozzle body according to Line III—III in FIG. 2.
Figure 2:
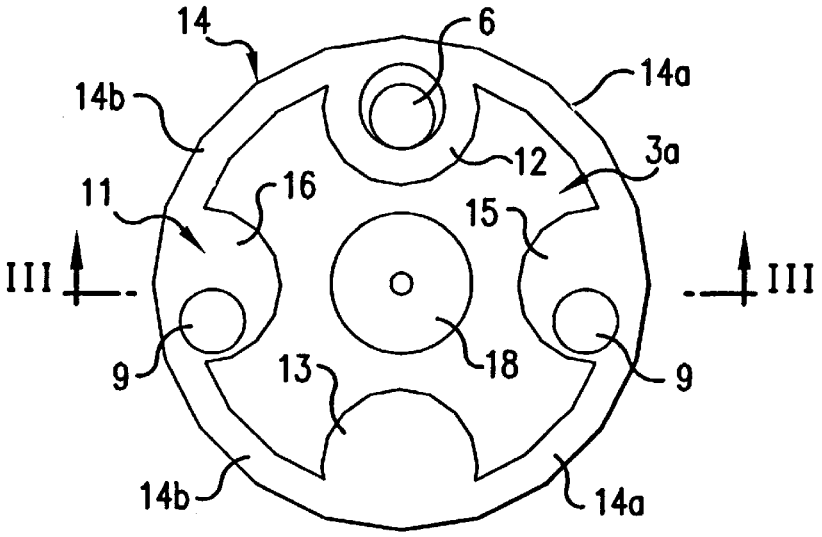
FIG. 2 is a view of a nozzle-holder-side face of the nozzle body with a contact surface consisting of hump-type surface parts.

Nozzle body 3 and nozzle holder 4 have interacting faces 3*a* and 4*a* respectively. As shown in FIGS. 2 and 3, a portion of the face 3*a* of the nozzle body 3 is provided with a raised, planely constructed contact surface 11 which consists of differently designed surface elements. The remaining portions of the face 3*a* are therefore set back by approximately 0.1 mm. The set back faces have no contact with the face 4*a* of the nozzle holder 4.

Figure 4:
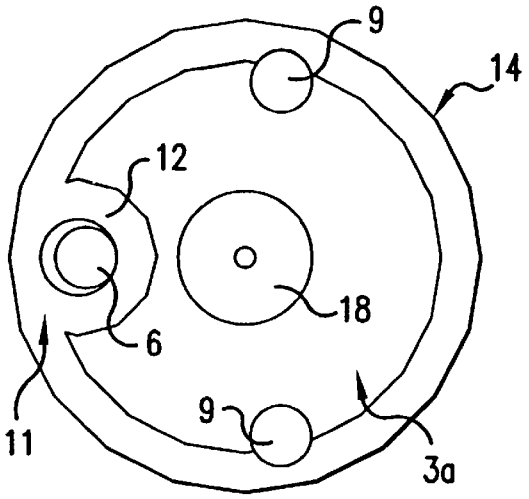

In the case of highly stressed fuel injection valves, surface elements are preferably used of which one surface element 12 is constructed to be ring-shaped or eye-like and surrounds a fuel-carrying transfer point of the feed pipe 6. In addition, a fuel-carrying transfer point in the area of the blind hole 18 provided for the nozzle needle 2 is surrounded by a surface element 14 which, on the circumference side, extends on the edge of the face 3*a* (FIGS. 2, 4, 5).

Figure 5:
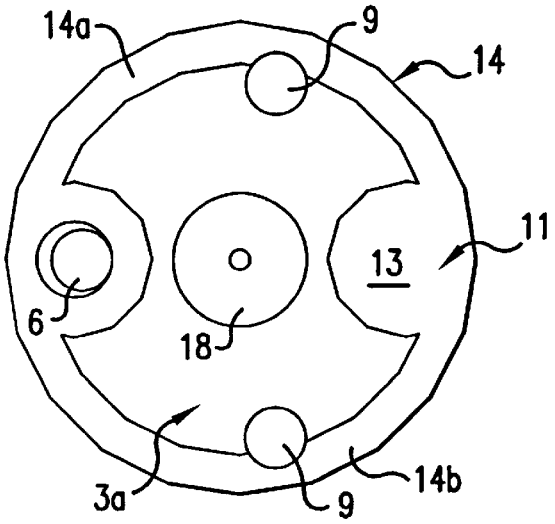

In order to avoid an asymmetrical bracing of the nozzle body 3 with the nozzle holder 4, a disk-shaped surface element 13 is also provided which is situated diametrically opposite the surface element 12 (FIGS. 2, 5). As the result, the surface element 14 is divided into circular segments 14*a* and 14*b*.

A construction of this type results in a perfect sealing function and furthermore in an optimal supporting effect because uniform bracing takes place. The danger of tilting is excluded in this case.

In order to prevent a shearing-off of the protection against torsion during mounting operations, enlarged and mutually opposite disk-shaped surface elements 15, 16 are also provided between the circular segments 14*a* and 14*b* and surround the blind holes 9 (FIG. 2). The set-back portion of the face 3*a* has a cross-type design.

All surface elements 12, 13, 14, 15, 16 have the same height level and rest in the same manner on the adjacent and planely constructed face 4*a* of the nozzle holder 4.

Figure 6:
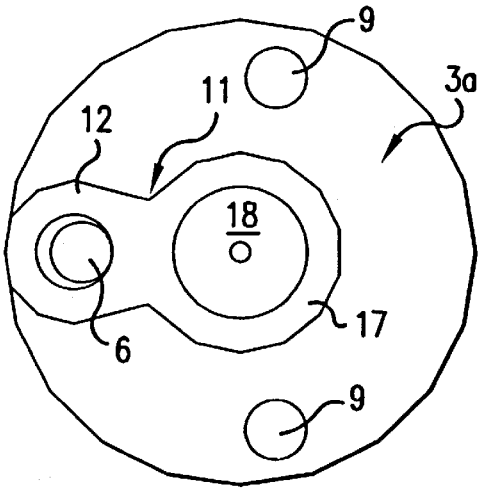

The additional figures show simplified embodiments which, as required, can be used for corresponding injection systems. The embodiments according to FIGS. 6 and 7 contain no surface element 14 shaped to form circular segments, but a surface element 17 is used here which directly surrounds the fuel-carrying transfer point of the blind hole 18 intended for guiding the nozzle needle. This surface element 17, which also has a disk-shaped construction, changes in a web-type manner into the surface element 12 (FIG. 6).

Figure 7:
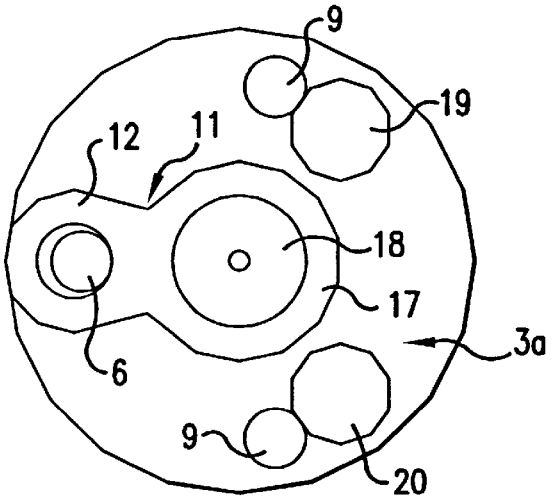

In FIG. 7, additional disk-shaped surface elements 19, 20 are also formed adjacent to the blind holes 9 and result in additional supporting points.

Figure 8:
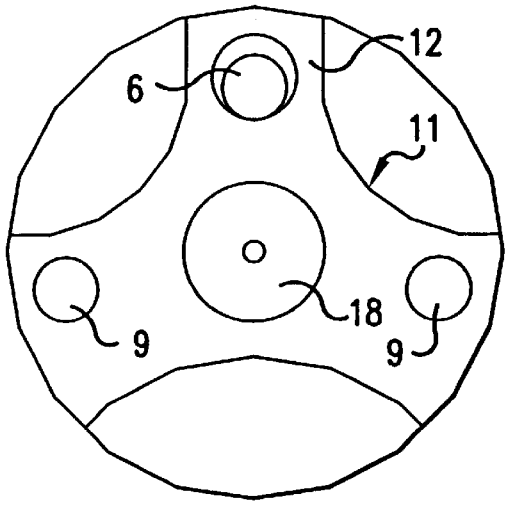
FIGS. 4 to 8 are views of various embodiments having different surface parts on the face of the nozzle body.

In the embodiment according to FIG. 8, the surface elements 19, 20 have a very enlarged construction such that they surround the blind holes 9 and thus protect the pins 10 against being sheared off. The surface elements 12, 17, 19 and 20 are coalescent and have the shape of a triangle.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fuel injection valve for internal combustion engine, comprising:

a nozzle needle longitudinally displaceably guided in a nozzle body, a tensioning nut adapted to axially brace the nozzle body and a nozzle holder, at least one feed pipe extending in the nozzle holder and the nozzle body, and fuel-carrying transfer points between the nozzle holder and the nozzle body, wherein a portion of at least one of the nozzle body and the nozzle holder have respective interacting faces, at least one of which is constructed as a raised contact surface with surface elements surrounding the fuel-carrying transfer points.

2. A fuel injection valve according to claim 1, wherein one of the surface elements surrounds the transfer point formed by the fuel feeding pipe and another surface element surrounds the transfer point formed by a blind hole for the nozzle needle.

3. A fuel injection valve according to claim 2, wherein one of the surface elements has an eye-type construction, and another of the surface elements is formed by at least one circular segment extending on an edge side on the face.

4. A fuel injection valve according to claim 3, wherein a disk-shaped surface element is situated diametrically opposite the eye-type surface element.

5. A fuel injection valve according to claim 1, further comprising:

blind holes situated coaxially to one another in adjacent faces, wherein a raised contact surface has additional surface elements which are situated opposite one another and are penetrated by blind holes, and all surface elements form a cross-type design of the set back portion of one of the faces.

6. A fuel injection valve according to claim 1, wherein a centrally situated and disk-shaped surface element surrounds a blind hole receiving the nozzle needle and is connected by way of a web with one of the surface elements.

7. A fuel injection valve according to claim 1, wherein additional surface elements are positioned adjacent to mutually opposite blind holes or include these and, together with the surface elements, form a triangular shaped contact surface.

8. A fuel injection valve comprising:

a nozzle needle longitudinally displaceably guided in a nozzle body;

a tensioning nut which axially connects the nozzle body with a nozzle holder, the nozzle body and nozzle holder each being provided with a respective interacting face; and at least one fuel feed pipe extending through the nozzle holder and the nozzle body, the nozzle body and nozzle holder having fuel transfer points between them, wherein a portion of at least one of the interacting faces is provided with a raised contact surface having surface elements which surround the fuel transfer points.

9. A fuel injection valve according to claim 8, wherein one of the surface elements surrounds a fuel transfer point formed by the fuel feed pipe and at least one other surface element surrounds a fuel transfer point formed by a blind hole for the nozzle needle.

10. A fuel injection valve according to claim 9, wherein the surface element surrounding the fuel transfer point formed by the fuel feed pipe has an eye-type construction, and the at least one other surface element surrounding the fuel transfer point formed by the blind hole for the nozzle needle is formed by at least one circular segment extending on an edge side on the interacting face.

11. A fuel injection valve according to claim 10, further comprising:

a disk-shaped surface element positioned diametrically opposite the eye-type surface element.

12. A fuel injection valve according to claim 8, further comprising:

blind holes situated coaxially to one another in adjacent interacting faces, wherein the raised contact surface has additional surface elements positioned opposite one another through which the blind holes extend, further wherein the surface elements are positioned as a whole to form a cross-type design on the interacting face.

13. A fuel injection valve according to claim 9, further comprising:

a centrally positioned, disk-shaped surface element surrounding the blind hole receiving the nozzle needle and is connected by way of a web with the surface element.

14. Fuel injection valve according to claim 1, further comprising:

additional surface elements positioned adjacent to mutually opposite blind holes form a triangular-shaped surface on the interacting face in combination with the other surface elements.

15. A method for preventing fuel leakage in a fuel injection valve comprising:

forming a nozzle holder having a central bore, a fuel feed bore and an interacting face;

forming a nozzle body having a central bore in which a nozzle needle is longitudinally and displaceable positioned, a fuel feed bore and an interacting face;

forming a raised contact surface on the interacting face of either the nozzle holder or the nozzle body, at least a portion of the raised contact surface having formed thereon at least one surface element positioned so as to surround the fuel feed bore;

co-axially arranging the nozzle body and nozzle holder such that the fuel feed bore of both are aligned thereby forming a fuel transfer point therebetween, the at least one surface element surrounding the fuel transfer point; and maintaining the nozzle body and nozzle holder in a connected position with a tensioning nut.

16. The method according to claim 15, further comprising:

forming another surface element on the raised contact surface to surround another fuel transfer point formed by the central bore for the nozzle needle.

17. The method according to claim 16, further comprising:

forming the surface element surrounding the fuel transfer point formed by the fuel feed pipe as an eye-type element; and forming the at least one other surface element surrounding the fuel transfer point formed by the blind hole for the nozzle needle as at least one circular segment extending on an edge side on the interacting face.

18. The method according to claim 17, further comprising:

positioning a disk-shaped surface element diametrically opposite the eye-type surface element.

19. The method according to claim 15, further comprising:

forming blind holes coaxially to one another in adjacent interacting faces;

forming additional surface elements in the raised contact surface, positioned opposite one another through which the blind holes extend; and positioning the additional surface elements in such a manner so as to form a cross-type design on the interacting face.

20. A fuel injection valve according to claim 16, further comprising:

centrally positioning a disk-shaped surface element to surround the blind hole receiving the nozzle needle and connecting the disk-shaped surface element by a web with the surface element.

21. The method according to claim 15, further comprising:

forming additional surface elements positioned adjacent to mutually opposite blind holes which form a triangular-shaped surface on the interacting face in combination with the other surface elements.

* * * * *